US005732988A

United States Patent [19]

Mizuki

[11] Patent Number: 5,732,988

[45] Date of Patent: Mar. 31, 1998

[54] VEHICLE DOOR LATCH DEVICE WITH POWER DOOR CLOSING MECHANISM

[75] Inventor: Tetsuro Mizuki, Nirasaki, Japan

[73] Assignee: Mitsui Kinzoku Kogyo Kabushiki Kaisha, Tokyo, Japan

[21] Appl. No.: 761,601

[22] Filed: Dec. 6, 1996

Related U.S. Application Data

[63] Continuation of Ser. No. 448,664, May 24, 1995, abandoned.

[30] Foreign Application Priority Data

May 24, 1994 [JP] Japan ..... 6-133759

[51] Int. Cl.[6] ..... E05C 3/06

[52] U.S. Cl. ..... 292/201; 292/DIG. 25; 292/DIG. 41

[58] Field of Search ..... 292/201, 144, 292/DIG. 25, DIG. 41

[56] References Cited

U.S. PATENT DOCUMENTS

| | | | |
|---|---|---|---|
| 2,382,985 | 8/1945 | Fitzgerald | 180/289 |
| 2,973,984 | 3/1961 | Burke . | |
| 3,243,216 | 3/1966 | Peters | 292/201 |
| 4,266,816 | 5/1981 | Mukai et al. | 292/129 |
| 4,364,249 | 12/1982 | Kleefeldt | 70/264 |
| 4,459,834 | 7/1984 | Seki | 70/256 |
| 4,796,929 | 1/1989 | Gergoe | 292/28 |
| 4,810,012 | 3/1989 | Baynes | 292/28 |
| 4,824,152 | 4/1989 | Jeavons | 292/216 |
| 4,858,452 | 8/1989 | Ibrahim | 70/275 |
| 4,968,074 | 11/1990 | Yamagishi et al. | 292/201 |
| 4,984,385 | 1/1991 | DeLand | 49/280 |
| 4,995,654 | 2/1991 | Nishigami et al. | 292/216 |
| 5,035,452 | 7/1991 | Rogers | 292/125 |
| 5,039,145 | 8/1991 | Frye | 292/336.3 |
| 5,273,324 | 12/1993 | Kobayashi | 292/201 |
| 5,288,115 | 2/1994 | Inoue et al. | 292/201 |
| 5,531,489 | 7/1996 | Cetnar | 292/225 |
| 5,577,782 | 11/1996 | Johnson et al. | 292/216 |

FOREIGN PATENT DOCUMENTS

| | | |
|---|---|---|
| 0226529 | 6/1987 | European Pat. Off. . |
| 0 606 922 | 7/1994 | European Pat. Off. . |
| 76982 | 9/1991 | Japan . |
| 1431580 | 4/1976 | United Kingdom . |
| 2 194 581 | 3/1988 | United Kingdom . |
| 2196381 | 4/1988 | United Kingdom . |
| 2276665 | 10/1994 | United Kingdom . |

*Primary Examiner*—Steven N. Meyers
*Assistant Examiner*—Gary Estremsky
*Attorney, Agent, or Firm*—Browdy and Neimark

[57] ABSTRACT

A vehicle door latch device enclosed entirely within a vehicle door comprises a latch unit having a fork member which engages with a striker fixed to a vehicle body and a pawl which engages with the fork member for preventing the fork member from reversing, a power unit for turning the fork member from a half-latch position to a full-latch position, and a cable for transmitting power of the power unit to the fork member. The cable has a middle portion provided in vicinity of a bottom edge of the door, a first end portion which is provided in proximity of a rear edge of the door in such a manner as to extend nearly vertically, and a second end portion which extends almost parallel with the first end portion and is connected to the power unit.

3 Claims, 5 Drawing Sheets

VEHICLE DOOR LATCH DEVICE WITH POWER DOOR CLOSING MECHANISM

This application is a continuation of application Ser. No. 08/448,664, filed May 24, 1995, now abandoned.

FIELD OF THE INVENTION

This invention generally relates to a vehicle door latch device and more particularly to a latch device provided with a power door-closing mechanism which can completely close a door by using power from a motor.

DESCRIPTION OF THE RELATED ART

Previously, there has been known a conventional latch device consisting of a latch unit, which has a fork member engaging with a striker or a latch bolt and further has a pawl engaging the fork member, and a power unit which has a motor for turning the fork member from a half-latch position to a full-latch position. When the fork member engages with the striker and is thus placed at the half-latch position, the power unit causes the fork member to turn to the full-latch position so as to close a door completely.

Upon occasion, the power unit is rather large in size, so that the power unit can not be attached to an edge portion of the door, to which the latch unit is fitted, and is thus provided in a central portion of the door, in which a large space can be easily secured (see the Japanese Utility Model Publication No. 3-76982/1991). In the case where both of the units are placed apart from each other in this way, these units are connected with each other through a wire cable. The power unit transmits power to the fork member of the latch unit by winding up the wire cable.

The wire cable of the conventional device connects both of the units with each other in line. Thus the wire cable is put through the central portion of the door, which is very likely to become largely deformed in a motor accident. The deformation of the door central portion sometimes results in the wire cable being pulled and in the fork member being forced to the full-latch position. When the device is in such a state, it becomes very difficult to open the door.

SUMMARY OF THE INVENTION

Accordingly, an object of the present invention is to provide a door latch device by which the influence on an operation of opening a door can be minimized even when the door is badly dented.

Other objects, features and advantages of the present invention will become apparent from the following description of a preferred embodiment with reference to the accompanying drawings in which like reference characters designate like or corresponding parts throughout several views.

DETAILED DESCRIPTION OF THE PREFERRED EMBODIMENT

Hereinafter, the preferred embodiment of the present invention will be described in detail by referring to the accompanying drawings.

Figure 1:
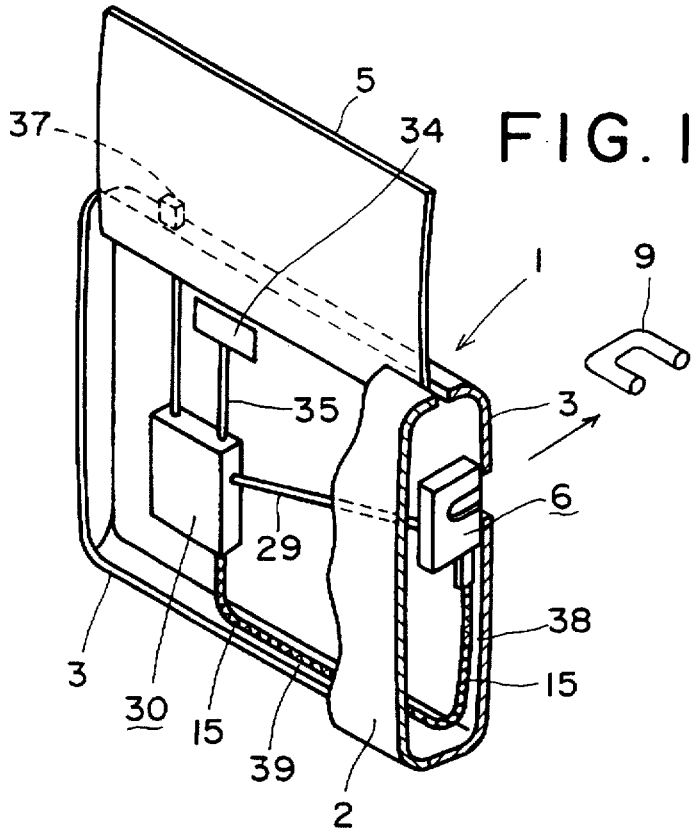
FIG. 1 is a diagram for showing the placement of a door and a latch device.
Figure 2:
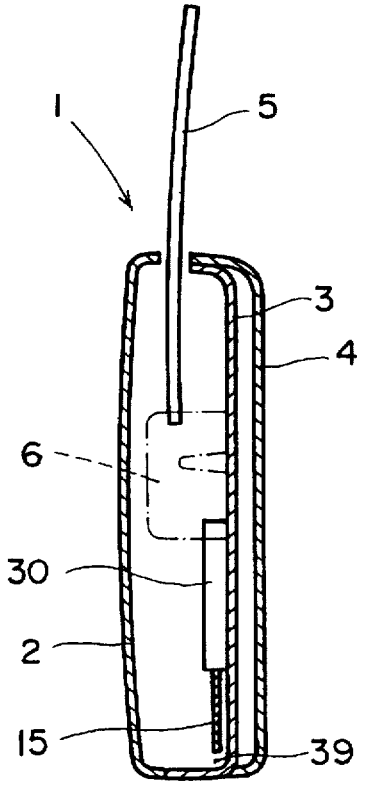
FIG. 2 is a sectional view of the door.

FIGS. 1 and 2 illustrate a door 1 and various components of a door latch device. The door 1 has a metallic outer panel 2, a metallic inner panel 3 and a decorative or trim panel 4 (see FIG. 2) and a window glass 5.

Figure 3:
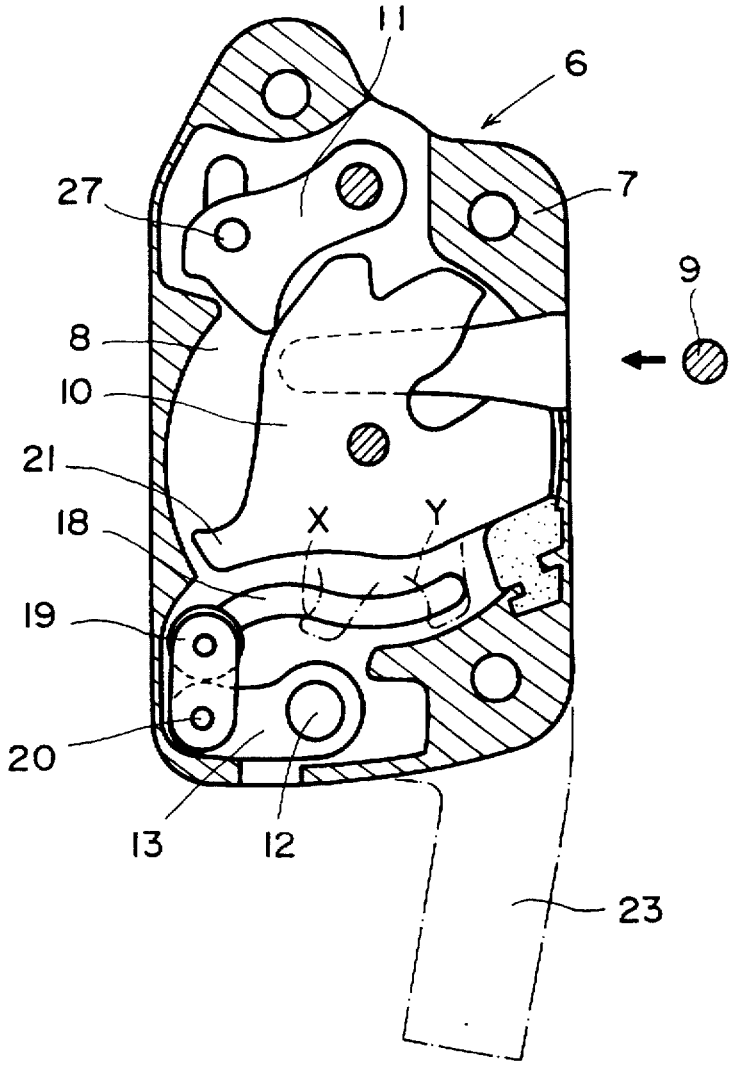
FIG. 3 is a front view of a latch unit.

At a rear end of the door 1, a latch unit 6 is provided between the outer panel 2 and the inner panel 3. As shown in FIG. 3, the latch unit 6 has a fork member 10 to be engaged with a striker 9 and then be turned, and also has a pawl 11 to be engaged with the fork member 10 so as to prevent the member 10 from reversing. Both of the fork member 10 and the pawl 11 are enclosed in a front recess portion 8 of a latch body 7.

A locking lever 13 is fixed to an end portion of a connecting shaft 12 provided at the lower portion of the body 7. A pressing component 19 to be guided along a groove 18 formed in the body 7 is secured to the locking lever 13 with a pin 20.

Figure 4:
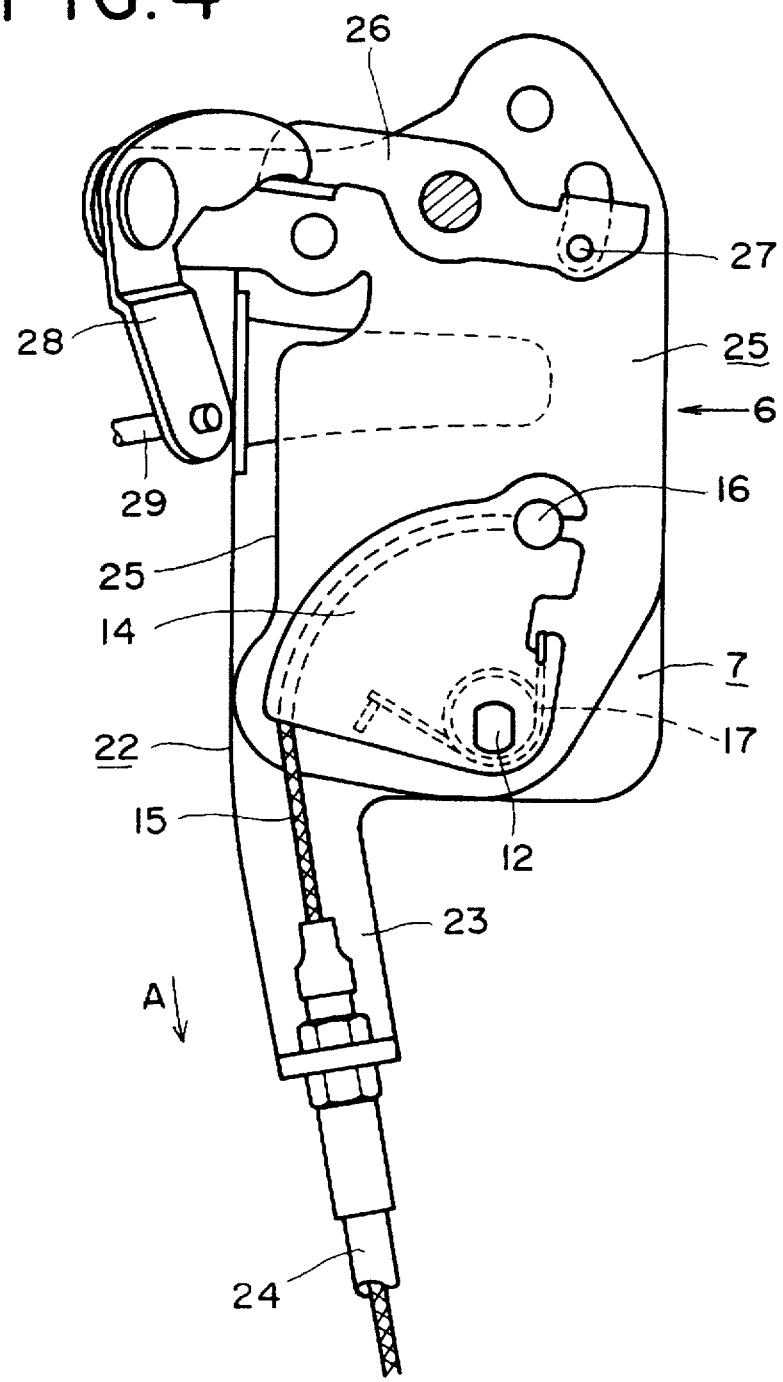
FIG. 4 is a rear view of the latch unit.

The other end portion of the connecting shaft 12 pierces the body 7 and protrudes from the rear surface thereof. A fan-shaped cable lever 14 is fixed to the protruding portion of shaft 12, as illustrated in FIGS. 3 and 4. A head 16 of a cable 15 led to a power unit 30 is engaged with and is attached to the cable lever 14. The locking lever 13 is connected and integrated with the cable lever 14 through the connecting shaft 12. When the power unit 30 is turned off, the locking lever 13 and the cable lever 14 are held in the positions of FIGS. 3 and 4, respectively, by the resilience of a spring 17. When the cable 15 is wound up in the direction of an arrow A by means of the power unit 30, the cable lever 14 and the locking lever 13 turn against the resilience of the spring 17. Consequently, the pressing component 19 is moved to the left along the guide groove 18.

In the fork member 10, a leg portion 21 radially extending from the axis of rotation thereof is provided. When the fork member 10 is engaged with the striker 9 and is turned to the half-latch position X, the leg portion 21 overlaps the guide groove 18. The power unit 30 starts winding up the cable 15 when the fork member 10 is in the half-latch position. Thereby, the pressing component 19 engages with the leg portion 21 and causes the fork member 10 to turn to the full-latch position Y. Thus, even in the case where the door 1 is not completely shut by performing a manual operation, the door 1 can be completely closed with the assistance of the power unit 30.

Figure 5:
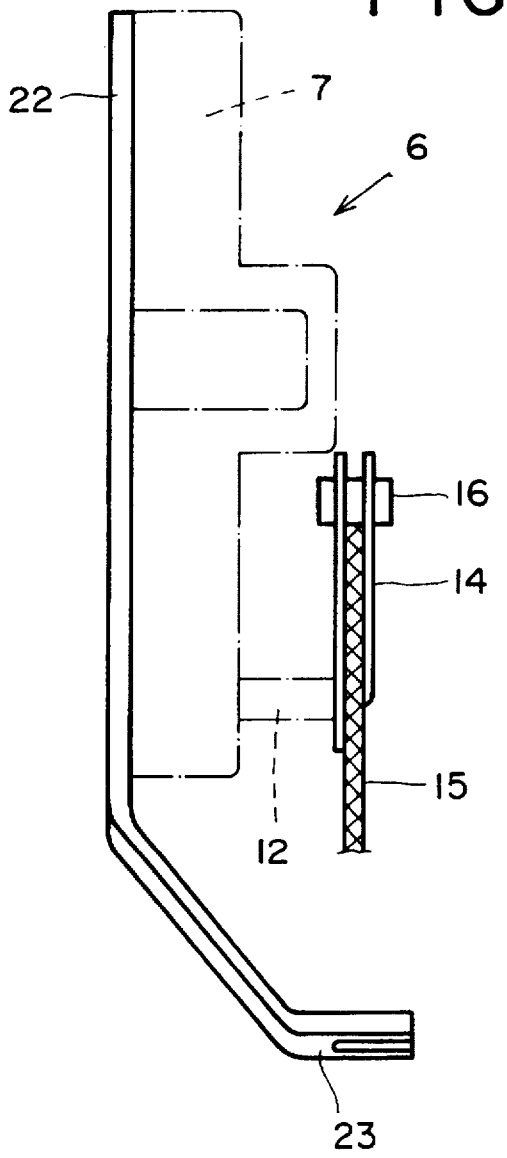
FIG. 5 is a side view of the latch unit.

As shown in FIG. 5, a cover plate 22 for closing the recess portion 8 is attached to the front surface of the body 7. A cable supporting portion 23, to which an end portion of a shell 24 of the cable 15 is fitted, is formed in such a manner as to be integral with the cover plate 22.

A pawl lever 26 which is connected to the pawl 11 through a pin 27 is rotatably attached to the rear surface of the body 7. An intermediate lever 28 is rotatably supported on a back plate 25 attached to the rear surface of the body 7. The intermediate lever 28 is indirectly connected through a rod 29 to an opening handle 34 (see FIG. 6) provided on the door 1. When the intermediate lever 28 is turned by operating the opening handle 34, the pawl lever 26 rotates around the axis of rotation thereof. As a result, the pawl 11 is detached from the fork member 10. Consequently, the door 1 is opened.

The power unit 30 is placed a little to the front of the door center position at a height which is nearly equal to or lower than that of the latch unit 6. The power unit 30 is usually fixed to the inner surface of the inner panel 3.

Figure 6:
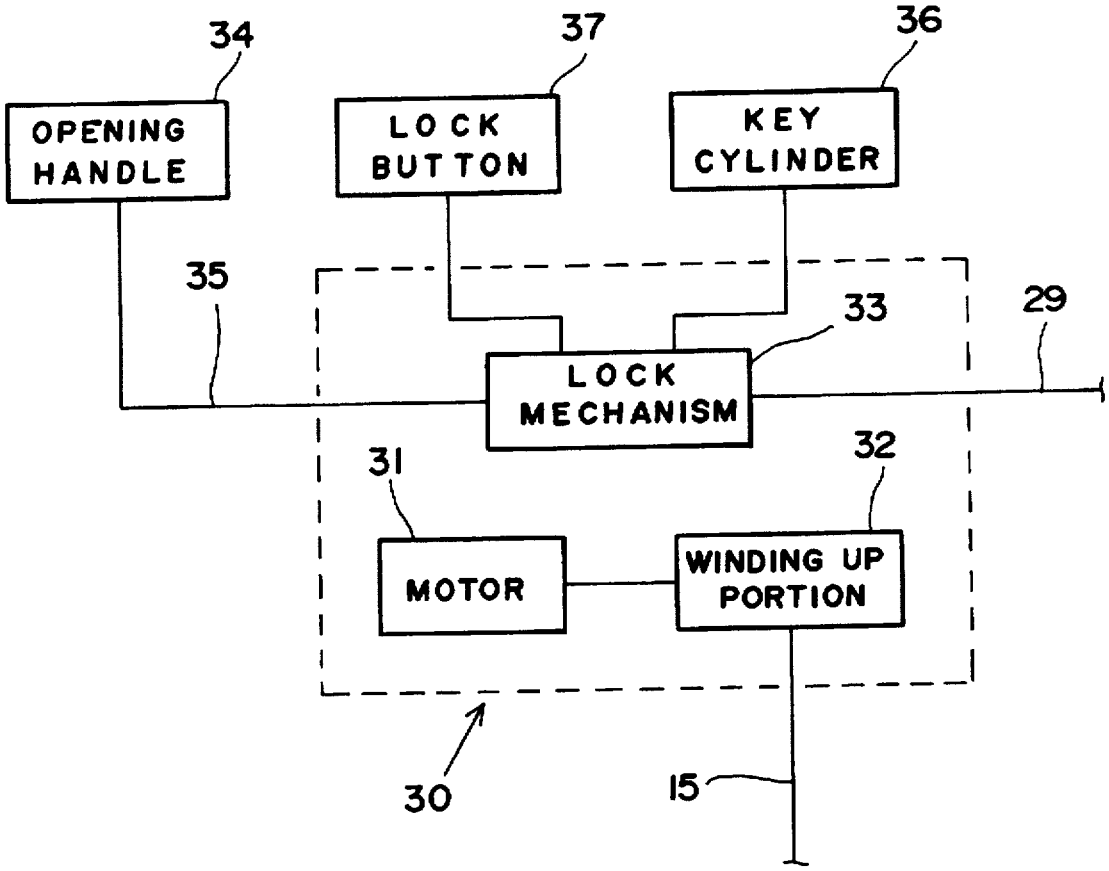
FIG. 6 is a block diagram for illustrating the configuration of a power unit.

FIG. 6 illustrates the configuration of the power unit 30. The configuration of the power unit 30 does not relate directly to the subject matter of the present invention and therefore will be briefly described hereinbelow. The power unit 30 has a winding up portion 32 connected to the other end portion of the cable 15, a motor 31 for rotating the winding up portion 32, and a lock mechanism 33. The lock mechanism 33 is changed between a locked state and a unlocked state by means of a key cylinder 36 or an inside lock button 37 of the door 1. The lock mechanism 33 is connected to the opening handle 34 through a rod 35 and is also connected to the intermediate lever 28 through the rod 29. When the lock mechanism 33 is in the unlocked state, the rods 29 and 35 come to be connected to each other with the result that the intermediate lever 28 can be turned by operating the opening handle 34. In contrast, when the lock mechanism 33 is in the locked state, the connection between the rods 29 and 35 is canceled. Consequently, the opening handle 34 comes to be unable to rotate the intermediate lever 28.

As shown in FIGS. 1 and 2, the middle portion of the cable 15 is placed in the vicinity of the bottom edge 39 of the door 1 in such a manner as to extend nearly horizontally therein. One end portion of the cable 15 extends upwardly from the bottom edge 39 along a rear edge 38 of the door 1 and is further connected to the latch unit 6. The other end portion of the cable 15 extends upwardly from the bottom edge 39 and is further connected to the winding up portion 32 of the power unit 30. The cable 15 bypasses the central portion of the door 1 in this manner. Consequently, unfavorable movement of the cable 15, which is caused by the deformation of the door 1, can be prevented considerably.

Prevention of deformation of the cable 15 can be further enhanced by placing the cable 15 closer to the inner panel 3 than to outer panel 2.

In the case of the aforementioned embodiment, the wire supporting portion 23 is provided in such a manner as to be integral with the cover plate 22. The wire supporting portion 23, however, may be provided therein in such a way to be integral with the body 7 or with the back plate 25.

Although the preferred embodiment of the present invention has been described above, it should be understood that the present invention is not limited thereto and that other modifications will be apparent to those skilled in the art without departing from the spirit of the invention.

The scope of the present invention, therefore, is to be determined solely by the appended claims.

What is claimed is:

1. A vehicle door latch device enclosed substantially within a vehicle door comprising:

a latch unit mounted on a rear edge of the door and spaced away from a bottom edge of the door, said latch unit having a fork member which engages with a striker fixed outside the door to a vehicle body, and a pawl which engages with the fork member for preventing the fork member from reversing;

a motorized power unit for turning the fork member from a half-latch position to a full-latch position; said power unit spaced away from said latch unit and bottom edge of the door adjacent a central portion of the door; and a cable provided within the door and having a first portion engaged to the fork member, a second portion connected to the power unit, and a middle portion between the first and second portions transmitting mechanical power from the power unit to the fork member when the second portion of the cable is wound on the power unit;

wherein said middle portion is horizontally provided in vicinity of the bottom edge of the door, said first portion is provided in proximity of the rear edge of the door in such a manner as to extend nearly vertically, and said second portion extends along parllel with the first portion.

2. The vehicle latch device according to claim 1, wherein a cable support means is fixed to the latch unit and has a cable supporting portion which holds a shell of the first portion of the cable and extends downwardly.

3. The vehicle door latch device according to claim 1, wherein said latch unit is provided between a metallic outer panel and a metallic inner panel of the door, said cable is placed so that the inner panel is nearer to the cable than the outer panel.

* * * * *